US007273052B2

(12) United States Patent
Gossweiler

(10) Patent No.: US 7,273,052 B2
(45) Date of Patent: Sep. 25, 2007

(54) PNEUMATIC SEALING SYSTEM FOR PROTECTION MASKS

(75) Inventor: Otto Gossweiler, Effretikon (CH)

(73) Assignee: TVI Corporation, Glenn Dale, MD (US)

( * ) Notice: Subject to any disclaimer, the term of this patent is extended or adjusted under 35 U.S.C. 154(b) by 367 days.

(21) Appl. No.: 10/732,268

(22) Filed: Dec. 11, 2003

(65) Prior Publication Data

US 2005/0126572 A1 Jun. 16, 2005

(51) Int. Cl.
*A62B 18/08* (2006.01)

(52) U.S. Cl. ..... 128/206.26; 128/201.27

(58) Field of Classification Search ..... 128/201.27, 128/201.28, 202.22, 205.18, 205.22, 205.25, 128/206.24, 206.26
See application file for complete search history.

(56) References Cited

U.S. PATENT DOCUMENTS

| | | | | | |
|---|---|---|---|---|---|
| 865,996 | A | * | 9/1907 | Catt | 128/206.26 |
| 1,105,127 | A | * | 7/1914 | Drager | 128/206.26 |
| 1,169,996 | A | * | 2/1916 | Prindle | 128/205.19 |
| 3,018,776 | A | * | 1/1962 | Saitta et al. | 128/206.17 |
| 3,044,464 | A | * | 7/1962 | Gray | 128/205.25 |
| 3,715,032 | A | | 2/1973 | Nicko | |
| 3,731,717 | A | | 5/1973 | Potash | |
| 3,852,196 | A | | 12/1974 | Szpur | |
| 3,990,439 | A | | 11/1976 | Klinger | |
| 4,243,029 | A | * | 1/1981 | Apple | 128/204.21 |
| 4,257,415 | A | * | 3/1981 | Rubin | 128/200.21 |
| 4,384,576 | A | * | 5/1983 | Farmer | 128/205.18 |
| 4,402,316 | A | | 9/1983 | Gadberry | |
| 4,433,684 | A | | 2/1984 | Sarnoff | |
| 4,493,614 | A | * | 1/1985 | Chu et al. | 417/22 |
| 4,513,741 | A | * | 4/1985 | Demi | 128/205.25 |
| 4,529,514 | A | | 7/1985 | Gruett | |
| 4,574,799 | A | | 3/1986 | Warnke | |
| 4,682,993 | A | | 7/1987 | Todd | |
| 4,823,785 | A | | 4/1989 | Mancosu | |
| 4,841,963 | A | | 6/1989 | Vandeputte | |
| 4,915,106 | A | * | 4/1990 | Aulgur et al. | 128/207.11 |
| 4,924,861 | A | * | 5/1990 | Kiske et al. | 128/205.18 |
| 4,936,298 | A | * | 6/1990 | Nishina et al. | 128/205.13 |
| 4,961,420 | A | | 10/1990 | Cappa | |
| 4,971,051 | A | * | 11/1990 | Toffolon | 128/206.26 |
| 5,036,846 | A | * | 8/1991 | Aulgur et al. | 128/207.11 |

(Continued)

FOREIGN PATENT DOCUMENTS

DE 4241033 A1 6/1994

(Continued)

*Primary Examiner*—Danton DeMille
(74) *Attorney, Agent, or Firm*—Whiteford, Taylor & Preston; R. Christopher Rueppell

(57) ABSTRACT

A pneumatic sealing system for a gas mask, which seals the mask to the face of the user by using a pump that employs air from inside the gas mask to variably inflate a mask seal during the breathing cycle. A double diaphragm pump, which has a driving diaphragm and a driven diaphragm, is connected to the inflatable mask seal via a hose duct. The double diaphragm pump is driven by the pressure difference inside the gas mask. During inhalation, the driving diaphragm fills with ambient air and the driven diaphragm fills with filtered air. During exhalation, the driving diaphragm and the driven diaphragm compress, releasing and trapping air in the mask seal.

32 Claims, 4 Drawing Sheets

U.S. PATENT DOCUMENTS

| | | | | | |
|---|---|---|---|---|---|
| 5,065,745 | A | | 11/1991 | Meier | |
| 5,209,226 | A | * | 5/1993 | Goodley | 128/205.25 |
| 5,235,972 | A | | 8/1993 | Strong | |
| 5,427,091 | A | | 6/1995 | Phillips | |
| 5,503,147 | A | * | 4/1996 | Bertheau | 128/207.11 |
| 5,690,102 | A | * | 11/1997 | Bertheau et al. | 128/207.11 |
| 5,914,037 | A | | 6/1999 | Yen | |
| 6,039,045 | A | * | 3/2000 | Bertheau et al. | 128/207.11 |
| 6,155,258 | A | | 12/2000 | Voege | |
| 6,214,074 | B1 | | 4/2001 | Silviera | |
| 6,269,811 | B1 | | 8/2001 | Duff | |
| 6,325,116 | B1 | | 12/2001 | Savage | |
| 6,615,828 | B1 | | 9/2003 | Petherbridge | |
| 6,796,304 | B2 | | 9/2004 | Odell | |
| 6,823,867 | B2 | | 11/2004 | Avery | |
| 6,834,650 | B1 | * | 12/2004 | Fini et al. | 128/206.26 |
| 6,837,239 | B2 | | 1/2005 | Beizndtsson | |
| 7,101,412 | B2 | | 9/2006 | Gossweiler | |
| 2003/0005932 | A1 | * | 1/2003 | Rydgren | 128/204.18 |
| 2005/0051235 | A1 | | 3/2005 | Gossweiler | |

FOREIGN PATENT DOCUMENTS

| | | | |
|---|---|---|---|
| WO | 2005035365 | A2 | 4/2005 |
| WO | 2005055912 | A2 | 6/2005 |
| WO | 2005060374 | A2 | 7/2005 |
| WO | 2005061076 | A1 | 7/2005 |
| WO | 2005118072 | A1 | 12/2005 |
| WO | 2006028467 | A2 | 3/2006 |

* cited by examiner

PNEUMATIC SEALING SYSTEM FOR PROTECTION MASKS

BACKGROUND OF THE INVENTION

1. Field of the Invention

The present invention relates to a pneumatic sealing system for protection masks, and more particularly to a diaphragm pump that regulates the breathing cycle of the individual wearing the mask.

2. Description of Related Art

Respiratory devices, such as protection masks, also interchangeably referred to herein as gas masks or masks, are well known. Civilians, law enforcement, military personnel, fire fighters and other groups of individuals commonly referred to as first responders, hereinafter referred to as users, wear masks for protection from an environment containing harmful and possibly fatal air-born toxins or any other such hazardous material. Such toxins and materials are hazardous to respiratory systems and generally take the form of harmful gases, vapors, and particulate matter. The respiratory hazards may also include various agents, such as nuclear, biological and chemical (NBC) agents, which may be in the form of particulates, vapors and aerosols.

A gas mask generally protects users from contaminants, toxins, poisons, et al., present or contained in ambient air in two ways. First, the gas mask regulates the air ingested and/or inhaled during the breathing cycle of the user. Typically, a gas mask may include a number of fittings or apertures for receiving filter cartridges, canisters, and the like to protect the user from ingesting or inhaling gases, vapors and/or particulates from contaminated ambient air. Such fittings may include check valves and other seal units that provide an airtight coupling with such filter cartridges, etc.

Second, the gas mask is typically designed to form an air tight seal between the gas mask and the user. The air tight seal is formed around a user's head, specifically about the face of the user, to secure the user's head and face, both respiratory cavities and skin, from exposure and contact with the contaminated air source. The gas mask must properly fit the user's head and face so that it will be airtight during use. To ensure a proper seal, correct fit, including the ability to maintain and adjust for correct fit, is important. Conventional masks typically require the user to manually adjust straps attached to the gas mask, which are used to position and adjust the gas mask and form the air tight seal. However, manual adjustment of the mask is typically imprecise and may lead to exposure to hazardous contaminants. Moreover, the gas mask is typically subject to unintended movement during normal use, which is typically caused by movement by the user and the circulation of air in the mask during the inhalation and exhalation phases of the breathing cycle. Movement of the mask about the face of the user may compromise the integrity of the airtight seal, wherein the user is exposed to the harmful contaminants present or contained in the ambient air.

There is a need for a gas mask that allows a user to secure the mask efficiently and properly to the user's head to create a highly secure seal that prevents contaminants from being inhaled, ingested, or otherwise put in contact with the user. There is a further need for a gas mask that maintains a secure seal about the user's head during all phases of the user's breathing cycle.

SUMMARY OF THE INVENTION

Aspects of the present invention provide a pneumatic sealing system for gas masks to provide a secure seal from ambient contaminants around the head and about the face of a user.

One aspect of the present invention relates to a double diaphragm pump used to regulate air flow into the inflatable gas mask seal, which creates an air tight seal from contaminated ambient air between the user and the gas mask. The double diaphragm pump includes a driving diaphragm, which is fillable with ambient air, and a driven diaphragm, which is fillable with filtered air. During the inhalation phase of a; breathing cycle, the driving diaphragm fills with ambient air. The flow of ambient air into the driving diaphragm causes a decrease in air pressure in the driven diaphragm. Filtered air flows to the driven diaphragm and fills the driven diaphragm. Additionally, a connecting tube attached to the driving diaphragm and the driven diaphragm pulls the driven diaphragm open as the driving diaphragm expands. A one-way valve inside the driven diaphragm traps the filtered air inside the driven diaphragm. During the exhalation phase of the breathing cycle, the pressure inside the gas mask compresses the air in the driven diaphragm, forcing the air into the inflatable gas mask seal. At the end of the exhalation phase, a one-way valve positioned between the inflatable gas mask seal and the diaphragm closes to trap the air in the inflatable gas mask seal. The pump terminates operation after reaching a maximum air volume capacity of the mask seal or a predetermined maximum pressure difference between the exhalation pressure inside the mask and the pressure inside the inflatable elastic mask seal.

In another aspect of the present invention, an electrically driven pump regulates air flow into the inflatable gas mask seal, which forms an air tight seal between the gas mask and the user. In one variation, the electrically driven pump has a pair of opposed diaphragms, which reduce vibration. The electrically driven pump, which uses electromagnetic mechanisms to control the diaphragms, filters air from inside the mask when the pressure switch in the inflatable gas mask seal senses low pressure therein. The filtered air from the pump is routed to the inflatable gas mask seal via a duct where a one-way valve traps the air in the inflatable gas mask seal. The electrically driven pump ceases pumping filtered air after reaching a maximum air volume capacity in the inflatable gas mask seal or a predetermined upper pressure limit.

Additional advantages and novel features of the present invention will become more apparent from the following description.

DETAILED DESCRIPTION OF THE PRESENT INVENTION

The present invention, as disclosed herein, secures the gas mask on a user's head and about the face so as to prevent hazardous contaminants from entering the closed environment of the gas mask and exposing the respiratory system and skin of the user to harmful contaminants contained in the ambient air. The present invention pneumatically adjusts the positioning of the gas mask on the head and about the face of the user during all phases of the breathing cycle of the user. Furthermore, the present invention improves the sealing capability of the gas mask between the gas mask and the head and face of the user in all operation modes so as to prevent contaminants contained in the ambient environment from entering the internal space of the mask.

Figure 1:
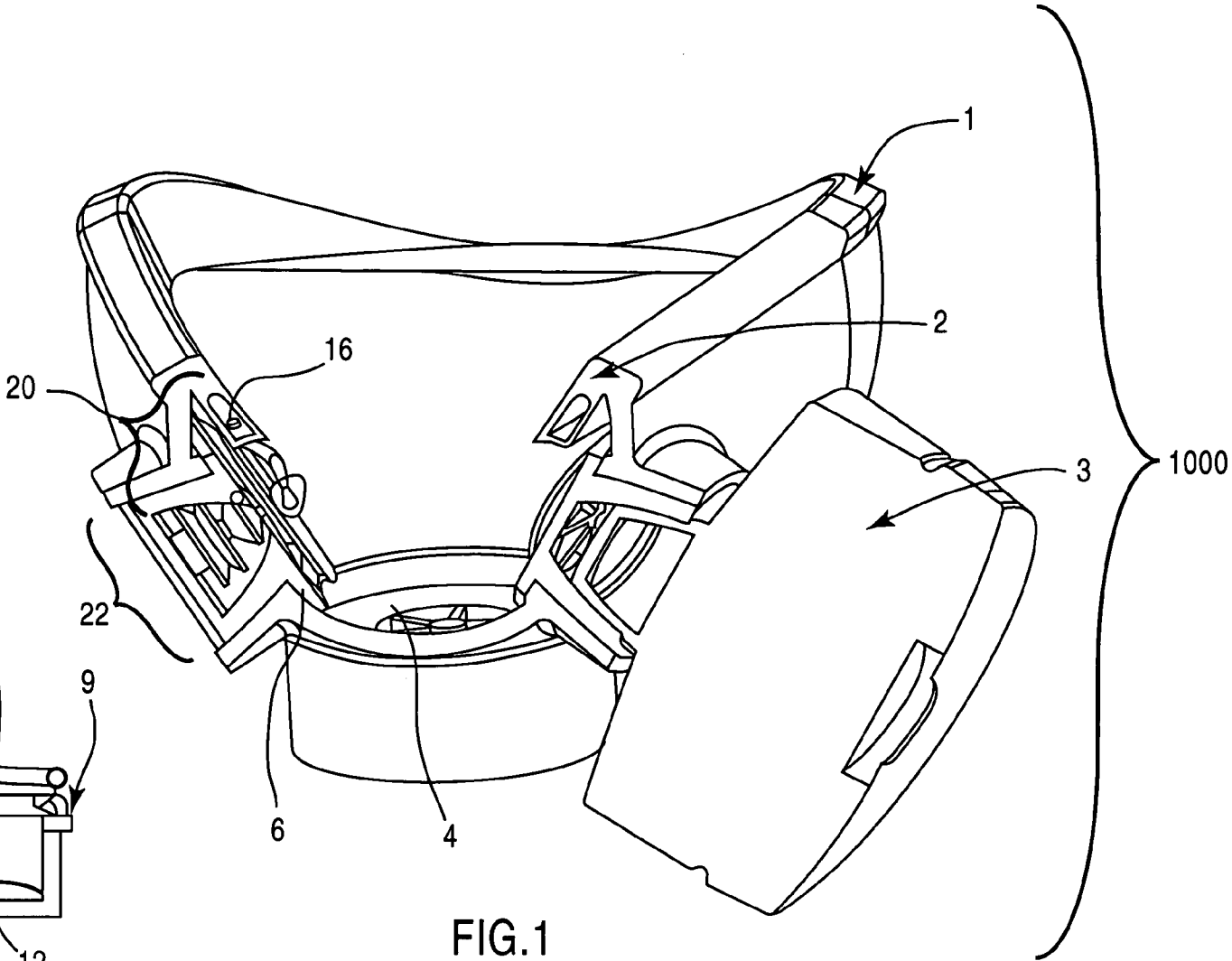
FIG. 1 is a partial cross-sectional, perspective bottom view of a gas mask having a pneumatic sealing system with an inflatable mask seal and a breathing cycle driven pump in accordance with one aspect of the present invention.
Figure 1A:
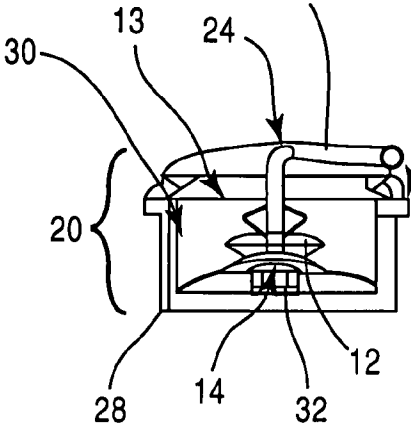
FIG. 1A is an expanded cross-sectional view of a breathing cycle driven pump having a double diaphragm pump in accordance with one aspect of the present invention.

In particular, FIGS. 1 and 1A illustrate one embodiment of the pneumatic sealing system 1000 for a gas mask 1 having a breathing cycle driven pump 6 including a double diaphragm 20. The double diaphragm pump 20 is attached, for example, to a filter port 22 for coupling to a protection filter 3. The double diaphragm pump 20 includes a driving diaphragm or first pump 13 and a driven diaphragm or a second pump 12. In one variation, the double diaphragm pump 20 is installed in a standard filter port 22. In one variation, the driving diaphragm 13 and the driven diaphragm 12 are connected to one another by a connecting tube 24. The connecting tube 24 feeds the filtered air from the driven diaphragm 12 to a duct 5. The double diaphragm pump 20 is connected to an inflatable mask seal 2 of the gas mask 1 via the duct 5. The duct 5 may be, for example, made of plastic, neoprene, rubber or any other suitable material. Furthermore, the duct 5 may be a flexible hose in one variation of the present invention. In one embodiment, the inflatable mask seal 2 extends about the circumference of the mask 1. The inflatable mask seal 2 is formed from, for example, plastic, neoprene, rubber or any other suitable material, and is ideally formed from halo-butyl runner, silicone rubber, chloro-butyl rubber, butyl silicone, EPDM, or bromo-butyl rubber.

During the inhalation phase of the breathing cycle, the pressure inside the mask 1 decreases. In some instances, the pressure inside the mask 1 may fall below ambient pressure. The actual pressure decrease depends on a number of factors, including, for example, the type of mask 1 and the cross-sectional area of at least one vent 28 that is operatively connected to the driving diaphragm 13. In one variation, the mask 1 has a plurality of vents 28. Low internal pressure in the mask 1 causes the driving diaphragm 13 to expand and thereby to fill with ambient air through at least one of the vents 28 to the driving diaphragm 13.

Simultaneously, or at least immediately after the ambient air enters the driving diaphragm 13, the driven diaphragm 12 fills with filtered air. The flow of ambient air into the driving diaphragm 13 causes the driven diaphragm 12 to fill with filtered air. In one embodiment, the filtered air enters the driven diaphragm 12 through an air inlet 9, which connects the internal space of the mask 1 with the driven diaphragm 12. The driving diaphragm 13 and the driven diaphragm 12 are connected, wherein activity in the driving diaphragm 13, i.e., fills with ambient air, which is then pressurized due to exhalation by the user, causes activity in the driven diaphragm 12, i.e., fills with filtered air, which is pressurized by the action of the driving diaphragm 13 produced by exhalation by the user.

For example, in one variation, pressure decreases in the mask 1 as a result of inhalation by the user. The decrease in pressure in the mask 1, in turn, causes the driving diaphragm 13 to fill with ambient air. The filling of air in the driving diaphragm 13, in turn, results in a decrease pressure in the driven diaphragm 12. The decrease of pressure in the driven diaphragm 12 forces filtered air to enter the driven diaphragm 12. The driven diaphragm 12 expands as filtered air enters the driven diaphragm 12.

In another variation, the driving diaphragm 13 mechanically causes the driven diaphragm 12 to fill with filtered air. The driving diaphragm 13 expands as it fills with ambient air, and the connecting tube 24 moves as a result of this expansion, which is linked to both the driving diaphragm 13 and the driven diaphragm 12, thereby causing and the driven diaphragm 12 to also expand. The movement of the connecting tube 24 thus mechanically causes the driven diaphragm 12 to expand and fill with filtered air.

An internal flapper valve 14, also interchangeably referred to herein as an internal "one-way valve," which is located inside the driven diaphragm 12, for example, traps the filtered air inside the driven diaphragm 12. The internal one-way valve 14 is of a type known in the art and allows gas or fluid exchange only in one direction. Other similar acting valves known in the art for allowing gas or fluid exchange in only one direction may likewise be used. In one variation, the one-way valve 14 prevents backflow of filtered air flow into the mask 1. The net effect during inhalation is that air flow escapes from the inflatable gas mask seal 2 into the internal space between the mask 1 and the face of the user. The air flow escaping the seal 2 reduces the air pressure in the inflatable gas mask seal 2.

During the exhalation phase of the breathing cycle, the pressure inside the mask 1 rises. As shown in FIG. 1, for example, the pressure, which is controlled by an outflow valve 4, may rise to 1 to 3 mbar. In one variation, the pressure inside the mask 1 compresses the driving diaphragm 13. Compression of the driving diaphragm 13, in turn, compresses the air inside the driven diaphragm 12. The filtered air from the driven diaphragm 12 exits the driven diaphragm 12, enters the duct 5, and flows into the inflatable mask seal 2 of the mask 1.

At the end of the exhalation phase, an external one-way valve 16, also referred to herein as an external flapper valve, closes and does not allow the air from the driven diaphragm 12 to flow back to the driven diaphragm 12. The external one-way valve 16 is positioned within the passageway between the driven diaphragm 12 and the inflatable gas mask seal 2. For example, the external one-way valve 16 is located at a junction of the duct 5 and gas mask seal 2. As such, the closing of the external one-way valve 16 traps the air inside the inflatable gas mask seal 2.

In one embodiment of the present invention, the pump 20 ceases the flow of filtered air to the inflatable gas mask seal 2. In one variation, the pump 20 ceases flow of filtered air to the mask seal 2 when the inflatable gas mask seal 2 can no longer accept an additional amount of air, i.e. at the maximum air capacity of the inflatable gas mask seal 2. The maximum air capacity of the inflatable gas mask seal 2 is reached, for example, when the pressure difference between the exhalation pressure inside the mask 1 and the inflatable gas mask seal 2 reaches its maximum pressure level.

Since exhalation pressure inside the mask 1 is a result of lung air content, exhalation valve outflow resistance, and speed of exhalation, the exhalation pressure is limited by the user's physiological limits. As the pressure inside the inflatable mask seal 2 reaches the same pressure as the driven diaphragm 12, which is also limited by the above-mentioned physiological limits of the user, the pressure on both sides of the one-way flapper valve 14 and 16 approaches equilibrium. At equilibrium, the force to close the one-way valve 14 and 16 diminishes. The one-way flapper valve 14 and 16 closes as the exhalation cycle nears its end, and the pressure created by the driven diaphragm 12 is reduced again to pressure level lower than the pressure level inside the inflatable gas mask seal 2.

Figure 2:
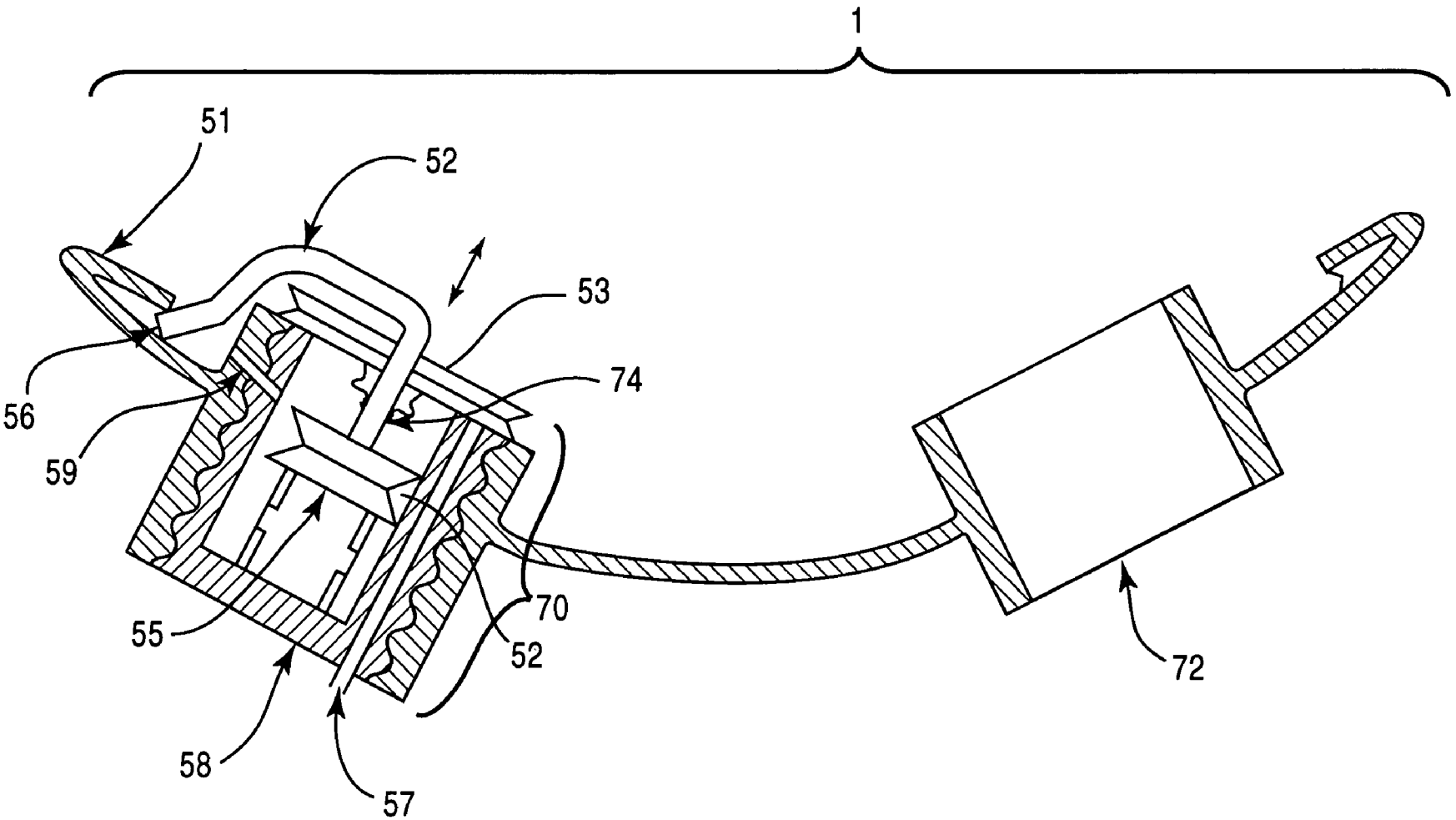
FIG. 2 is a schematic diagram illustrating the pneumatic gas mask sealing system with a breathing cycle driven pump in accordance with one aspect of the present invention.

The operation of the double diaphragm pump, in one variation of the present invention, will now be described in greater detail. In this variation, as shown in FIG. 2, a duct 82, also referred to herein as an air line is connected to an inflatable gas mask seal 51. An external one-way valve 56, also referred to as an external flapper valve, is disposed at the junction of the duct 82 and the inflatable gas mask seal 51. FIG. 2 also illustrates a housing 58 for the double diaphragm pump 70, which includes, for example, a vent 57 to the ambient environment, which leads to the driving diaphragm 53, and a vent port 59, which communicates air between the internal portion of mask 1 and the interior of the pump housing 58. The double diaphragm pump 70 also includes a driving diaphragm 53 and a driven diaphragm 52, which are connected via a connecting tube 74, which, for example, is connected to the duct 82.

Figures 3, 3A:
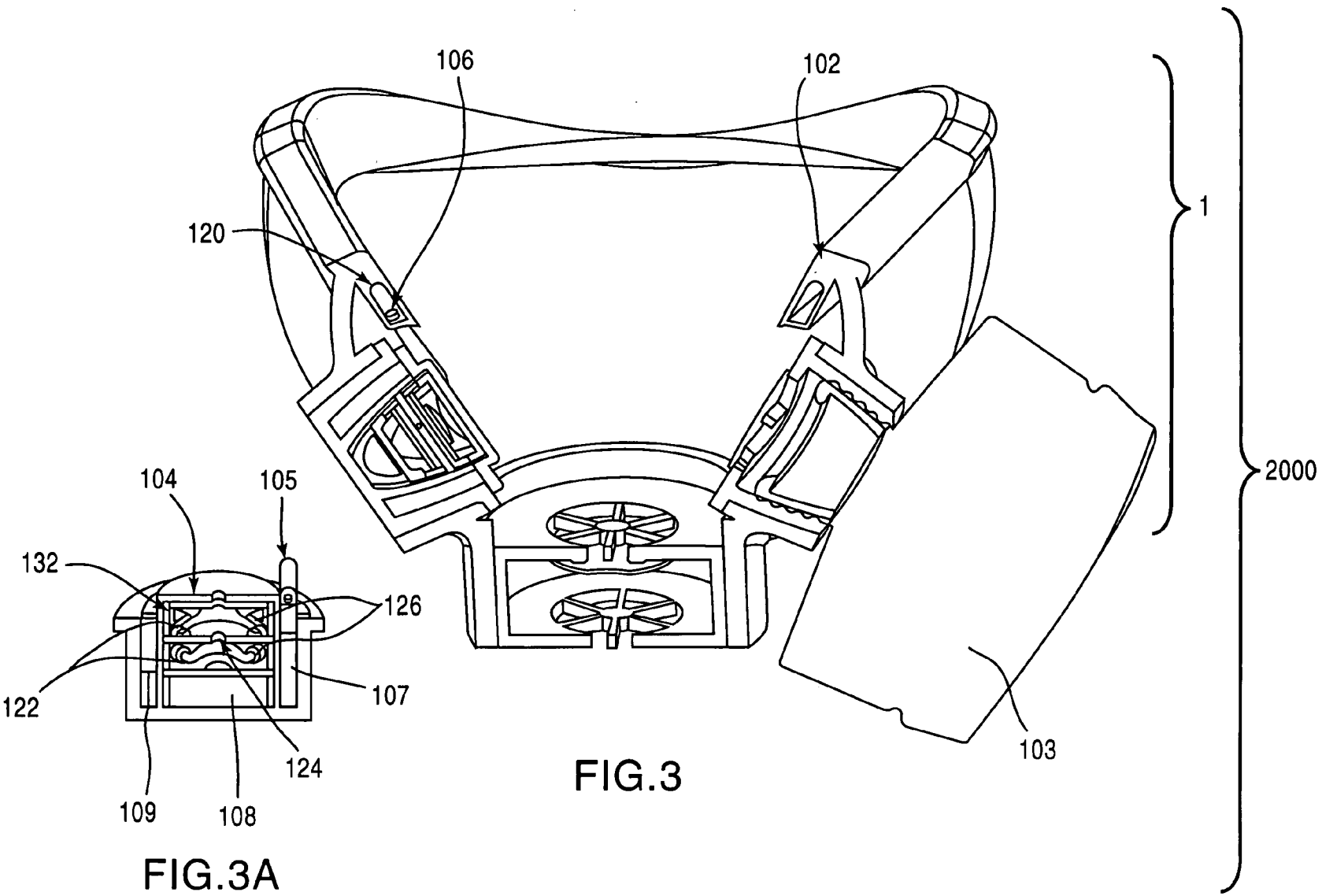
FIG. 3 is a partial cross-sectional, perspective bottom view of a gas mask having a pneumatic sealing system with an inflatable mask seal and an electrically driven pump in accordance with one aspect of the present invention.
FIG. 3A is an expanded cross-sectional view of an electrically driven pump having a dual diaphragm pump with an opposed configuration in accordance with one aspect of the present invention.

FIG. 3 illustrates another embodiment of a pneumatic sealing system 2000 for an inflatable gas mask seal 102 of a gas mask 101, wherein the system includes an electrically driven pump 104. In one embodiment, the electrically driven pump 104 forces filtered air from inside the mask 101 to the inflatable mask seal 102. In this embodiment, the electrically driven pump 104 includes one chamber. Preferably, in another embodiment of the present invention, the electrically driven pump 104 has two chambers 122 and is referred to as a dual diaphragm pump. In this embodiment, the two chambers 122, defined as a first chamber and a second chamber, of the electrically driven pump 104 are positioned on opposite sides (also referred to as opposed design) of a division member 124, which includes a duct 105 connected to the inflatable gas mask seal 102. The opposed design of the dual chambers (also known as diaphragms) 122 in the electrically driven pump 104 eliminates counter momentum between the diaphragms 122 as well as the resultant vibration, which increases the comfort associated with using the mask 101.

The electrically driven pump 104 operates based on pressure levels inside the mask 101. A pressure switch 120, which may be built into the inflatable elastic mask seal 102 or alternatively, placed at a location inside the gas mask 101, turns on the electrically driven pump 104 upon reaching a low level air pressure threshold, such as during the inhalation phase of the breathing cycle, in which air pressure inside the mask 101 decreases, as previously described. Filtered air in the mask 101 flows through at least one air inlet 109 to the chambers 122 of the electrically driven pump 104. A one-way valve 132 allows the filtered air to travel in one direction to the chambers 122. As a result, the two chambers 122 of the electrically driven pump 104 expand as the filtered air enters the two chambers 122. A one-way valve 126, also known herein as an internal flapper valve, which is located in each of the two chambers 122, forces filtered air into the seal 102.

After reaching the upper pressure threshold, such as during exhalation, the pressure switch 120 turns off the electrically driven pump 104. During exhalation, the compressed air from the two chambers 122 is fed to the inflatable elastic mask seal 102 via a duct 105, which is flexible in one variation of the invention. An external one-way valve 106, also known herein as an external flapper valve, which regulates airflow to the inflatable mask seal 102, is positioned at some location in the flowable passageway from the electrically driven pump 104 to the inflatable gas mask seal 102. Preferably, the external one-way valve 106 is positioned at the junction of the inflatable mask seal 102 and the duct 105. The external one-way valve 106 traps the air inside the mask seal 102 after shutdown of the electrically driven pump 104.

Figure 4:
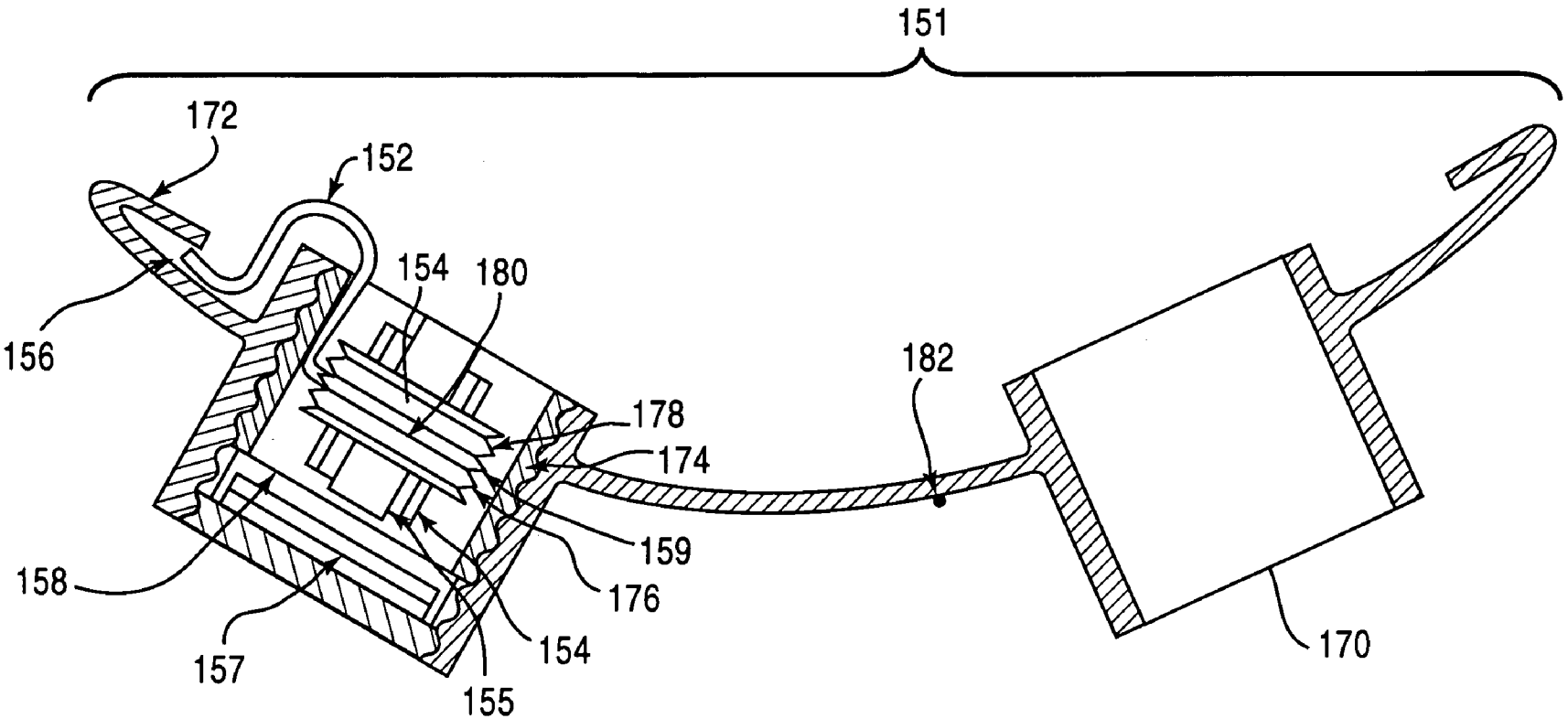
FIG. 4 is a schematic diagram illustrating the pneumatic gas mask sealing system with an electrically driven pump in accordance with one aspect of the present invention.

FIG. 4 illustrates one embodiment of the electrically driven pneumatic sealing system. An electrically driven opposed diaphragm pump 154 is powered by a battery 157, housed in a battery chamber 158. Preferably, the diaphragm pump 154 is opposed, i.e. the chambers 176, 178 of the pump 154 are positioned on opposite sides of the division member 180 and open towards the division member 180, to enhance the comfort of the mask user during operation. The chambers 176, 178 flowably connect to the division member 180, wherein the chambers 176, 178 empty the filtered air into the division member 180. The division member 180 functionally connects the emptied air to an air line 152, which directs the filtered air expelled from the chambers 176, 178 to an inflatable gas mask seal 172, also referred to herein as a V-seal.

A pressure sensor 182 detects air pressure inside the mask. During inhalation, when the air pressure inside the mask decreases, the pressure sensor 182 sends a pressure measurement signal to a processor 158, also known as a processing chip (PC) board or PCB. The PCB 158 sends an electrical pulse to a plurality of metal-based coils 164 interconnected to at least one permanent magnet 155, which is functionally connected to the diaphragm pump 154. The coils 164 and magnet 155 functionally form a solenoid or other similar device known in the art, wherein the coils 164 cause the magnet 155 to travel. In one variation, the coils 164 cause the magnet 155 linked to the diaphragm pump 154 to expand and contract as necessary using electromagnetic forces generally known in the art. The expansion and contraction of the pump 154 is intermittent, variable, or continuous, for example. The electrical stimulation required to drive the interaction between the coils 154 and the magnet 155 is produced by a battery 157, or other energy-generating device, such as a solar power pack or electrochemical pack generally known in art. For instance, during exhalation, the electrical pulse causes the diaphragm 154, i.e., each chamber 176, 178, to contract and to expel the air from the diaphragm 154 through the air line 152 to the V-seal 172. In one variation, the electrical pulse stimulates both chambers 176, 178 of the diaphragm 154 at the same time. The filtered air flowing to the V-seal 172 is retained in the V-seal 172 by a one-way valve, known as the external flapper valve 158, which allows filtered air to travel to the V-seal 172 and prevents filtered air from flowing back to the chambers 176, 178.

The pump 154 ceases operation at the end of the exhalation phase of the user's breathing cycle. In one embodiment, when the pressure in the V-seal 172 reaches a maximum point, the pressure sensor 182 sends a signal to the PCB 158. The PCB 158, in turn, ceases sending signals to the coils 154 and magnets 155 operating the chambers 176, 178 of the pump 154. Thus, as the pressure in the mask 151 decreases, the two chambers 176, 178 fill with filtered air via an air inlet 174. The air is taken into the chambers 176, 178 by a one-way valve, also known as the internal flapper valve 159, which allows air to enter the chambers 176, 178 and prevents air from escaping the chambers 176, 178.

While it has been described what is at present considered to be preferred embodiments of the present invention, it will be understood by one of ordinary skill in the art that various modifications may be made thereto, and it is intended that the appended claims cover all such modifications as fall within the true spirit and scope of the invention. Other modifications will be apparent to those skilled in the art.

What is claimed is:

1. A pneumatic sealing system for a gas mask, comprising:

a first pump defining a first chamber, wherein the first pump draws air from outside the gas mask into the chamber, the air drawn into the first chamber having an air pressure;

a second pump defining a second chamber and operatively connected to the first pump, wherein the second pump has a second chamber that receives filtered air from inside the gas mask; and an inflatable seal fluidly connected to the second pump, wherein the inflatable seal inflatably receives the filtered air from the second pump.

2. The pneumatic sealing system of claim 1, wherein an internal air pressure of the gas mask is below ambient pressure when the user of the gas mask inhales.

3. The pneumatic sealing system of claim 1, further comprising:

an air inlet extending through a wall of the second pump, wherein the filtered air is able to flow from inside the gas mask to the second chamber through the air inlet.

4. The pneumatic sealing system of claim 3, further comprising:

an internal one-way valve connected to the second pump, the internal valve sealably regulating airflow entering the second pump, wherein the filtered air flows from the air inlet to the second pump.

5. The pneumatic sealing system of claim 4, wherein the internal one-way valve is located in the second pump.

6. The pneumatic sealing system of claim 1, further comprising:

a vent extending through a wall of the first pump, wherein ambient air flows from outside the gas mask to the first chamber via the vent.

7. The pneumatic sealing system of claim 1, wherein the first pump and the second pump are operatively connected by a duct.

8. The pneumatic sealing system of claim 7, wherein the duct further connects the second pump to the inflatable seal, and wherein the filtered air flows into the inflatable seal.

9. The pneumatic sealing system of claim 8, wherein the duct is flexible.

10. The pneumatic sealing system of claim 8, further comprising:

An external one-way valve flowably attached to the duct and inflatable mask seal, wherein the filtered air flows from the second pump to the inflatable seal.

11. The pneumatic sealing system of claim 10, wherein the external one-way valve is positioned at a junction of the duct and the inflatable seal.

12. The pneumatic sealing system of claim 1, wherein the second pump terminates pumping of the filtered air to the inflatable seal when the pressure inside the gas mask equals a maximum pressure difference between an exhalation pressure inside the gas mask and the inflatable seal.

13. A pneumatic sealing system for a gas mask, comprising:

a pump defining a chamber;

a power source providing a pumping force of the pump;

an inflatable seal connected to the pump; and a pressure switch regulating a flow of air from the pump to the inflatable seal.

14. The pneumatic sealing system of claim 13, wherein the power source is portable.

15. The pneumatic sealing system of claim 14, wherein the power source is selected from a group consisting of: a battery, a portable solar powered energy member, and a portable device for an electrochemical reaction.

16. The pneumatic sealing system of claim 13, wherein the chamber comprises a first chamber portion and a second chamber portion.

17. The pneumatic sealing system of claim 16, wherein the first and second chamber portions are disposed opposite each other relative to a division member adjacent to the first and second chamber portions.

18. The pneumatic sealing system of claim 17, wherein the division member connects the chambers to the inflatable seal.

19. The pneumatic sealing system of claim 13, wherein the inflatable seal and the pump are connected via a flowable duct.

20. The pneumatic sealing system of claim 13, further comprising:

an internal one-way valve connected the chamber, the internal valve retaining airflow entering the chamber from inside the gas mask and preventing airflow from the chamber to the inside of the gas mask.

21. The pneumatic sealing system of claim 13, further comprising:

an air inlet to the pump that allows airflow from inside the gas mask to the chamber.

22. The pneumatic sealing system of claim 19, further comprising:

An external one-way valve allowing communication of an airflow from the pump through the duct and to the inflatable mask seal.

23. The pneumatic sealing system of claim 22, wherein the external one-way valve is positioned at a junction of the duct and the inflatable mask seal.

24. The pneumatic sealing system of claim 13, wherein the pump terminates pumping at a maximum pressure difference between the exhalation pressure inside the gas mask and the inflatable mask seal.

25. The pneumatic sealing system of claim 13, wherein the pressure switch detects an air pressure inside the gas mask or inside the inflatable gas mask seal and sends a signal to a processor.

26. The pneumatic sealing system of claim 25, wherein the pressure switch sends a signal to the processor to cease operation of the pump during exhalation.

27. The pneumatic sealing system of claim 26, wherein the processor processes the signal from the pressure switch and sends a processor signal to the power source.

28. The pneumatic sealing system of claim 25, wherein the power source receives the processor signal from the processor and sends an electrical current to at least one of a plurality of metallic coils and at least one magnet during inhalation when the air pressure in the mask decreases.

29. The pneumatic sealing system of claim 28, wherein the plurality of metallic coils are disposed around the chamber of the pump.

30. The pneumatic sealing system of claim 28, wherein the coils electromagnetically force the magnet to compress-the chamber when the power source sends an electrical current.

31. A pneumatic sealing system of claim 13, wherein the pump is housed in a housing in a filter port of the gas mask.

32. The pneumatic sealing system of claim 13, wherein the power source is replaceable.

* * * * *